US005104342A

United States Patent [19]

Liu et al.

[11] Patent Number: 5,104,342

[45] Date of Patent: Apr. 14, 1992

[54] STRUCTURE OF CABLE CONNECTOR

[75] Inventors: Yun-Yu Liu; Hsiao-Lei Shih, both of Taipei, Taiwan

[73] Assignee: Pan-International Industrial Corp., Hsin-Tien-Taipei, Taiwan

[21] Appl. No.: 686,520

[22] Filed: Apr. 17, 1991

[51] Int. Cl.[5] ..... H01R 13/502

[52] U.S. Cl. ..... 439/695; 439/903

[58] Field of Search ..... 439/589, 598, 695, 701, 439/607, 608, 609, 610, 752, 750, 901, 903

[56] References Cited

U.S. PATENT DOCUMENTS

| | | | |
|---|---|---|---|
| 4,072,383 | 2/1978 | Cameron et al. | 439/598 |
| 4,698,030 | 10/1987 | Ryll et al. | 439/752 |
| 4,786,260 | 11/1988 | Spaulding | 439/610 X |
| 4,802,869 | 2/1989 | Maue | 439/752 X |
| 4,820,204 | 4/1989 | Batty | 439/695 X |

*Primary Examiner*—Neil Abrams
*Assistant Examiner*—Khiem Nguyen
*Attorney, Agent, or Firm*—Fleit, Jacobson, Cohn, Price, Holman & Stern

[57] ABSTRACT

A cable connector comprising a plastic core covered with a cap and fastened in a short copper tube at one end. By engaging a plurality of raised portions at the inside of the cap in a plurality of notches around the periphery of the front projecting end of the plastic core, the cap is firmly attached to the plastic core and, the plug holes on the plastic core are respectively automatically longitudinally aligned with the holes on the cap for fastening terminals tightly. After having been covered with the cap, the plastic core is fastened in the short copper tube at one end to incorporate with the short copper tube into a consolidated piece convenient for performing further outer shell resin molding process.

3 Claims, 4 Drawing Sheets

STRUCTURE OF CABLE CONNECTOR

BACKGROUND OF THE INVENTION

The present invention relates to cable connectors and relates more particularly to a cable connector which requires less amount of parts to assemble and efficiently eliminates resin leakage problem during outer shell resin molding process.

The connector plug of a cable connector is generally comprised of an elongated copper tube, a plastic core, a back cover and a plurality of terminals. During manufacturing process, terminals are respectively connected with the conductors of a cable and inserted in the plug holes of a plastic-core and then firmly retained in place by a back cover. After the plastic core is fastened in an elongated cooper tube, a resin outer shell is molded on the elongated copper tube and the back cover to form a connector plug. Because the cylindrical front contact end of the terminals can not respectively tightly seal the square plug holes of the plastic core, resin may fill in the gap therebetween during resin outer shell molding process, causing electric contact failure or affect electric contact performance. There is provided a cable connector manufacturing process which can eliminate resin leakage problem by sealing the gap between the terminals and the plug holes of the plastic core through soldering process. However, soldering process complicates cable connector manufacturing operation and is difficult to control on quality. Recently, there is provided a cable connector manufacturing process in which the plastic core is comprised of two separate parts, namely a front part which has cylindrical plug holes longitudinally disclosed at one end and square plug holes longitudinally disposed at an opposite end and respectively aligned with said cylindrical plug holes, and a rear part which has square plug holes. When terminals are respectively inserted through the square plug holes of the rear part into the plug holes of the front part, the cylindrical plug holes of the front part are respectively tightly blocked by the cylindrical front end of said terminals and therefore, resin leakage problem is eliminated during resin outer shell molding process. In this structure of cable connector, fastening means must be made on the front and rear parts so that they can be firmly and precisely connected together. It is very difficult to make fastening means on the front and rear parts. Further, after the front and rear parts are connected into a plastic core, precise roundness of the plastic core is difficult to obtain.

In any of the aforesaid cable connectors manufacturing methods, it is very difficult to fasten a plastic core in a copper tube after cable conductors having been respectively connected to terminals and terminals having been respectively fastened in said plastic core. Because much amount of parts are needed to assemble into a cable connector, assembly process is relatively complicated.

SUMMARY OF THE INVENTION

The present invention has been accomplished to eliminate the aforesaid problems. According to a first aspect of the cable connector of the present invention, the plastic core has a cap attached to the cylindrical front projection thereof, which cap has holes longitudinally aligned with the plug holes on the plastic core and respectively made in such a shape to be tightly blocked by the cylindrical front contact end of the terminals inserted therein through the plug holes of the plastic core. According to a second aspect of the cable connector of the present invention the cap has a plurality of raised portions corresponding to a plurality of notches around the periphery of the cylindrical front projection of the plastic core and therefore, the cap can be conveniently firmly attached to the plastic core by engaging the raised portion thereof in the notches of the plastic core to fit flush with the outer surface of the plastic core without affecting the roundness thereof. According to a third aspect of the cable connector of the present invention, the cap and the plastic core are connected together and then fastened in a short copper tube at one end to incorporate said short copper tube into a consolidated piece convenient for performing further terminal fastening process and resin outer shell molding process.

DETAILED DESCRIPTION OF THE PREFERRED EMBODIMENT

Figure 1:
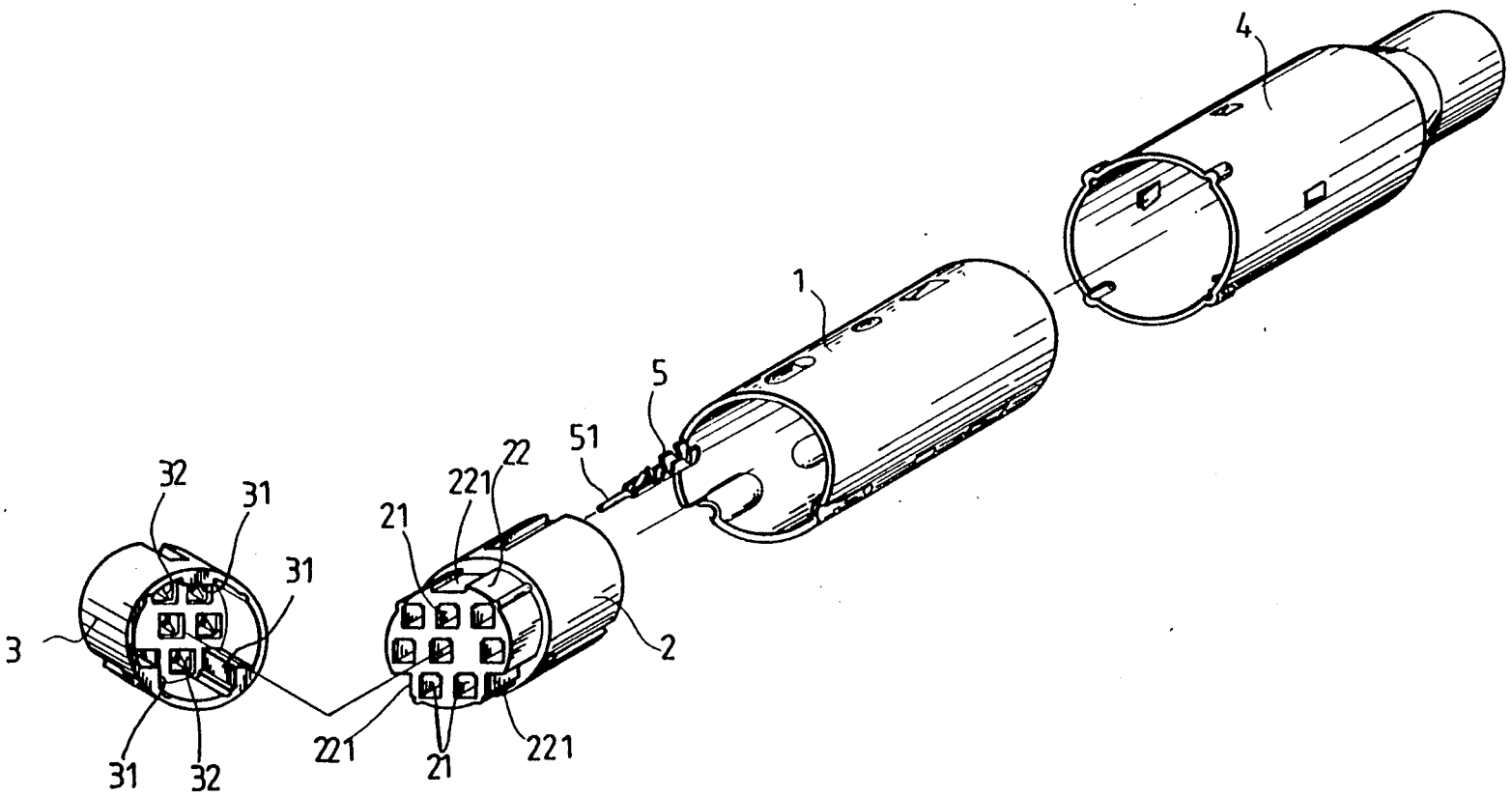
FIG. 1 is a dismantled perspective view of the preferred embodiment of the cable connector of the present invention.

Referring to FIG. 1, a cable connector in accordance with the present invention is generally comprised of a short copper tube 1, a plastic core 2, a cap 3, a back cover 4 and a plurality of terminals 5. The plastic core 2 is made in cylindrical shape having a cylindrical front projection 22 in relatively reduced outer diameter which has a plurality of notches 221 equidistantly respectively made on the periphery thereof in different shape for fastening the cap 3, and a plurality of square plug holes 21 longitudinally piercing therethrough for inserting terminals 6. The cap 3 has a plurality of raised portions 31 respectively engaged in the notches 221 of the plastic core 2, and a plurality of holes 32 longitudinally piercing therethrough and respectively longitudinally aligned with the square plug holes 21 of the plastic core 2. The holes 32 of the cap 3 are identical in shape, having each a cylindrical orifice at the front of a square passage, which cylindrical orifice is relatively smaller in diameter with respect to said square passage, After having been attached to the cylindrical front end 22 of the plastic core 2, the holes 32 of the cap 3 are respectively longitudinally aligned with the square plug holes 21 for fastening terminals 5 directly.

Figure 3:
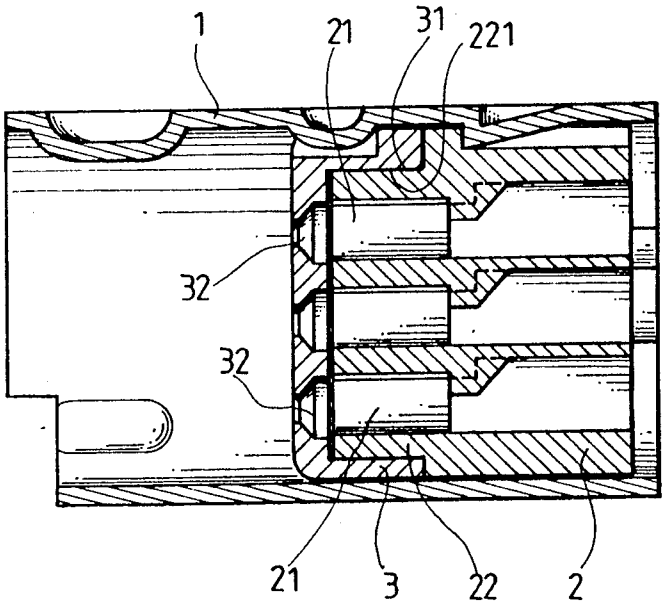
FIG. 3 is a sectional side view showing the connection of the cap and the plastic core in the short copper tube.
Figure 2:
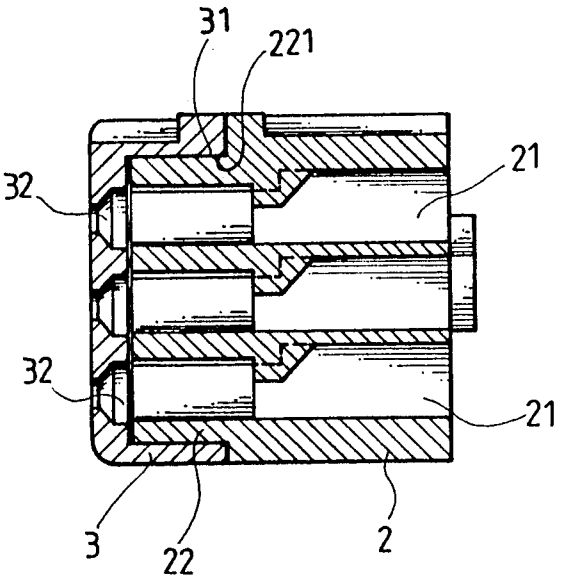
FIG. 2 is a sectional side view showing the connection of the cap with the plastic core.

After having been attached together during manufacturing process, the cap 3 and the plastic core 2 are directly fastened in the rear end of the short copper tube 1, as shown in FIG. 3, to incorporate with the short copper tube into a consolidated piece convenient for further processing into a connector plug. Because the plastic core 2 and the cap 3 are firmly attached to the rear end of the short copper tube 1 and the square plug holes 21 of the plastic core 2 are respectively longitudinally aligned with the holes 32 of the cap 3, terminals 5 can be conveniently fastened in the rear end of the short copper tube 1.

Figure 4:
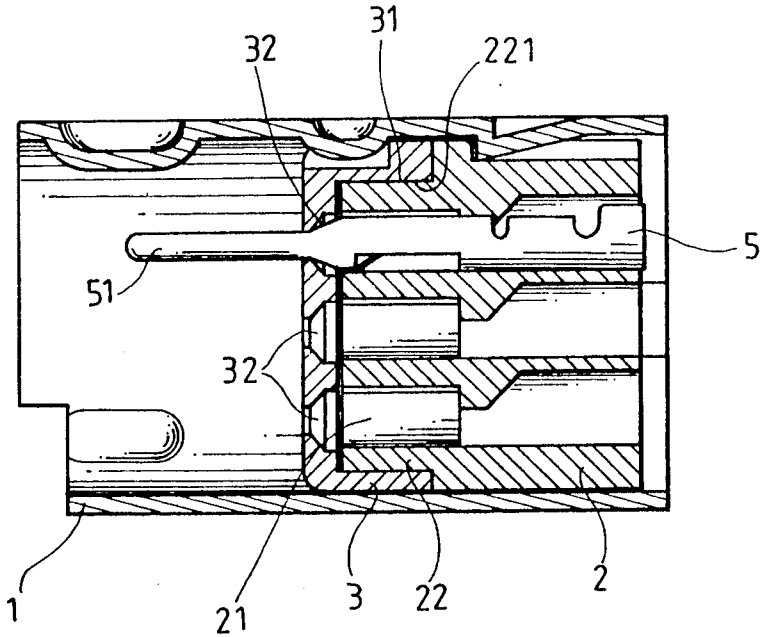
FIG. 4 is a sectional side view showing the fastening of a terminal in the plastic core and the cap inside the short copper tube to seal the cylindrical orifice of the corresponding hole on the cap.

Referring to FIG. 4, after terminals 5 are respectively fastened in the square plug holes 21 of the plastic core 2, the rear part of the cylindrical front connecting end 61 of each terminal 5 is tightly engaged inside the cylindrical orifice of a corresponding square plug hole 21 and therefore, resin molding process can be accurately performed during connector plug manufacturing process.

Figure 5:
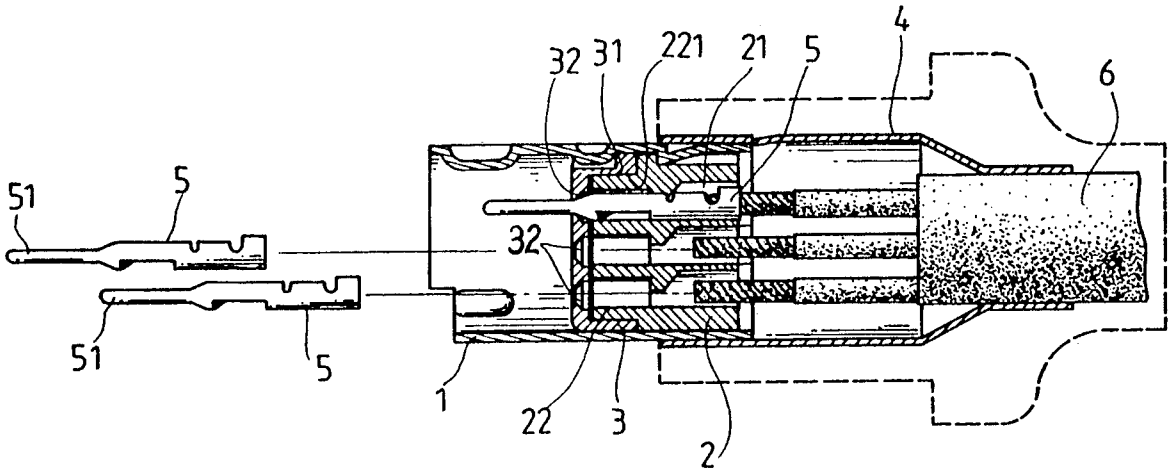
FIG. 5 is a sectional assembly view of the connector plug according to the present invention.

Referring to FIG. 5, after terminals are respectively fastened in the plastic core 2 and connected with the conductors of a cable 6, a back cover 4 is mounted on the rear end of the short copper tube 1 to firmly secure said cable 6 in place. The back cover 4 is to extend the length of the short copper tube 1 so as to meet the specified length of the connector plug to be made. As soon as the back cover 4 is attached to the plastic core 2 and the cable 6, resin is molded on the back cover 4 (as shown in the dotted line) to form an outer shell on the short copper tube 1.

What is claimed is:

1. A cable connector, comprising a short copper tube, a plastic core within said tube, a cap attached to the core, a cover over the copper tube, and a plurality of terminals extending through the core and cap, characterized in that:

said plastic core is made in cylindrical shape having a cylindrical front projection in relatively reduced outer diameter and a plurality of square plug holes longitudinally piercing therethrough for inserting said terminals, said cylindrical front projection having a plurality of notches equidistantly respectively made around the periphery thereof; and said cap has a plurality of raised portions at the inside respectively engaged in said notches of said plastic core, and a plurality of holes longitudinally piercing therethrough and respectively longitudinally aligned with said square plug holes of said plastic core forming into a plurality of passage ways for fastening said terminals, said holes of said cap having each a cylindrical orifice at the front of a square opening, said square opening being made in size equal to said square plug holes and respectively longitudinally disposed in alignment with said square plug holes.

2. The cable connector of claim 1, wherein said cap and said plastic core and connected together and then directly fastened in said short copper tube at one end to incorporate with said short copper tube into a consolidated piece.

3. The cable connector of claim 1 wherein the terminals are tightly engaged in the respective cylindrical orifices.

* * * * *